US011215424B1

(12) United States Patent
Paulson

(10) Patent No.: US 11,215,424 B1
(45) Date of Patent: Jan. 4, 2022

(54) MINIGUN ROTOR

(71) Applicant: Kristopher Lee Paulson, Hendersonville, TN (US)

(72) Inventor: Kristopher Lee Paulson, Hendersonville, TN (US)

( * ) Notice: Subject to any disclaimer, the term of this patent is extended or adjusted under 35 U.S.C. 154(b) by 0 days.

(21) Appl. No.: 17/129,870

(22) Filed: Dec. 21, 2020

(51) Int. Cl.
*F41F 1/10* (2006.01)

(52) U.S. Cl.
CPC ..... *F41F 1/10* (2013.01)

(58) Field of Classification Search
CPC ..... F41F 1/08; F41F 1/10
See application file for complete search history.

(56) References Cited

U.S. PATENT DOCUMENTS 3,380,343 A * 4/1968 Chiabrandy ..... F41F 1/10 89/12
6,742,434 B1 * 6/2004 Dillon ..... F41A 3/26 42/16
7,930,964 B1 * 4/2011 Dillon ..... F41A 13/06 89/12
2008/0092726 A1 * 4/2008 Dillon ..... F41A 13/06 89/12
2017/0205167 A1 * 7/2017 Abbott ..... F41A 9/30
2020/0263955 A1 * 8/2020 Dewalch ..... F41A 9/36

* cited by examiner

*Primary Examiner* — Gabriel J. Klein
(74) *Attorney, Agent, or Firm* — Jacob W Neu; Jessica Zurlo; Bradley Arant Boult Cummings

(57) ABSTRACT

An improved minigun rotor comprised of distinct components that can be removed from the rotor and subsequently replaced is provided. The improved rotor includes a tail having a shaft, where a plurality of bolt tracks is attached to one end of the shaft; a camming section including a first cam and a second cam mounted on a sleeve, where the sleeve is configured to be removably attached to the shaft; and a barrel cluster head including a plurality of barrel apertures, where the barrel cluster head is configured to be removably attached to the rotatable shaft and secured to an end of the shaft. The improved rotor allows for each of the components of the rotor to be replaced (rather than the entire rotor) if a catastrophic failure occurs or the components need to be repaired or replaced due to wear and tear.

7 Claims, 10 Drawing Sheets

MINIGUN ROTOR

FIELD OF THE DISCLOSURE

The present disclosure relates generally to firearms, and more particularly to a rotor for a multiple barreled rotary firearm, such as a minigun.

BACKGROUND

The modern minigun, or M134, is a machine gun which fires projectiles in an automatic fashion. The M134 minigun is a six-barrel rotary machine gun with a high rate of fire and featuring a Gatling-style rotating barrel assembly using an electric motor which is powered by an aircraft, ground vehicle, external battery pack or the like. The M134 minigun has a rotor positioned in the center of the firearm. The rotor is comprised of different parts that work together during the firing sequence. For instance, the rotor generally includes bosses to which bolt tracks are attached by a locking mechanism called the track stud. The track stud uses a distorted thread flange locknut to secure the bolt track to the rotor. This allows the bolt to slide forward and aft once installed into the bolt tracks, which are secured to the rotor. The head of the rotor allows the barrels to be mounted by inserting the barrels and rotating them one hundred and eighty degrees which allows them to lock into place. When the firearm is triggered, the motor turns the drive gear on the front of the rotor, which in turn drives the gun bolts through the firing sequence by spinning the rotor in a counter-clockwise rotation and using the cam path of the rotor housing to guide them in their circular motion.

The M134 rotors currently on the market, including those sold to the United States military and militaries around the world, are generally formed of a single piece of metal weighing over eight pounds. The standard manufacturing protocol for forming this type of rotor is to machine down a single large block of steel to form the various components of the rotor. This manufacturing process is very time consuming and results in a great deal of waste. Moreover, because the rotor is formed from a single piece of metal, the entire rotor must be scrapped or discarded when worn out or when a component of the rotor requires repair, such as when a catastrophic failure occurs during the use of the firearm. This means the end user (typically a military entity) must completely scrap the registered firearm and attempt to replace it, which is costly and requires long repair times.

Furthermore, even if the rotor is repairable on the aircraft, current M134 designs require that the crew carry a tool bag on the aircraft. Any extra weight on military aircraft can result in lost fuel and decreased range, which can threaten mission success or the life of the crew. Furthermore, the need for tools can make certain repairs on the aircraft impossible if the correct tool is not included.

Accordingly, there remains a need in the art for a minigun rotor having replaceable components that can extend the life span of the rotor itself and reduce manufacturing and maintenance costs of the firearm. There also remains a need in the art to reduce or eliminate the need for tools for on-board repair.

SUMMARY

An improved minigun rotor having replaceable components has been developed. In some embodiments, the present disclosure provides a rotor including a tail with a shaft having a distal end and a proximal end, wherein a plurality of tail bosses are arranged radially around the distal end of the shaft; a plurality of bolt tracks, each bolt track attached to a tail boss, wherein two adjacent bolt tracks define a pathway; a camming section mounted on a sleeve, wherein the sleeve is configured to removably engage the shaft adjacent to the bolt tracks, the camming section further having a plurality of bosses arranged radially around the sleeve and corresponding to each of the plurality of bolt tracks; and a barrel cluster head having a plurality of barrel apertures, wherein the barrel cluster head is configured to removably engage the shaft and secure to the proximal end of the shaft.

In other embodiments, the present disclosure provides a rotor for a minigun having a tail having a plurality of bosses, at least one boss having an indentation for receiving a clip and a locking bolt hole; a bolt track securable to the at least one boss and having an aperture passing through the bolt track and a clip insertable into the indentation; and a spring-loaded locking bolt configured to pass through the aperture in the bolt track and be removably secured within the locking bolt hole.

In one embodiment, the barrel cluster head may further include an opening and a plate disposed therein configured for attachment to the proximal end of the shaft. In another embodiment, the rotatable shaft, the sleeve, and the opening on the barrel cluster head each include a hexagonal cross-sectional profile. In still another embodiment, the proximal end of the shaft and the plate of the barrel cluster head each include complementary slots for insertion of a releasable fastener.

BRIEF DESCRIPTION OF THE DRAWINGS

Further features and advantages can be ascertained from the following detailed description that is provided in connection with the drawings described below.

DETAILED DESCRIPTION

Figure 1:
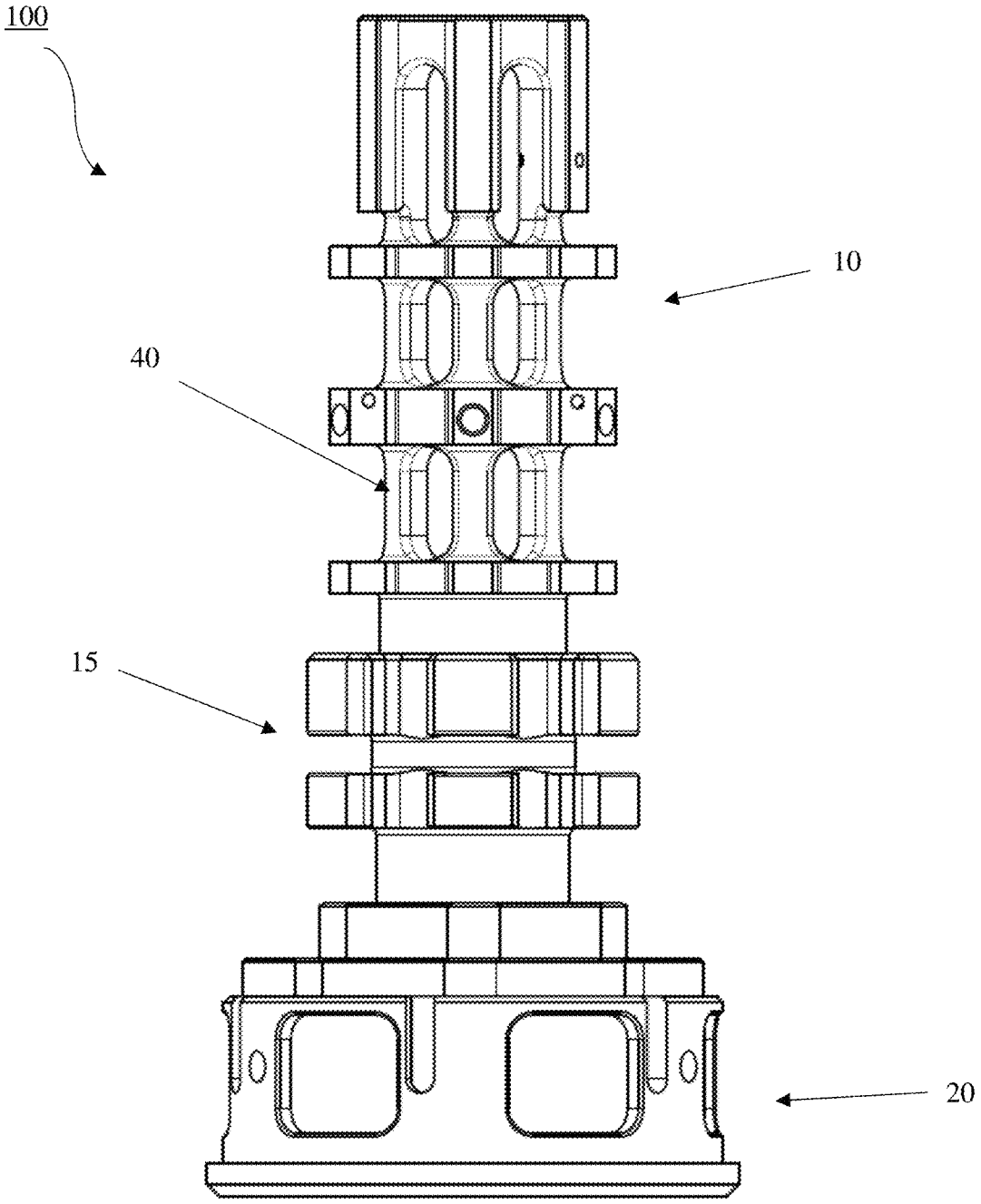
FIG. 1 is a side view of a rotor according to an exemplary embodiment of the present disclosure.

Unless otherwise defined, all terms (including technical and scientific terms) used herein have the same meaning as commonly understood by one of ordinary skill in the art of this disclosure. It will be further understood that terms, such as those defined in commonly used dictionaries, should be interpreted as having a meaning that is consistent with their meaning in the context of the specification and should not be interpreted in an idealized or overly formal sense unless expressly so defined herein. Well known functions or constructions may not be described in detail for brevity or clarity.

The terms "about" and "approximately" shall generally mean an acceptable degree of error or variation for the quantity measured given the nature or precision of the measurements. Typical, exemplary degrees of error or variation are within 20 percent (%), preferably within 10%, and more preferably within 5% of a given value or range of values. Numerical quantities given in this description are approximate unless stated otherwise, meaning that the term "about" or "approximately" can be inferred when not expressly stated.

The terminology used herein is for the purpose of describing particular embodiments only and is not intended to be limiting. As used herein, the singular forms "a", "an" and "the" are intended to include the plural forms as well (i.e., at least one of whatever the article modifies), unless the context clearly indicates otherwise.

Spatially relative terms, such as "under," "below," "lower," "over," "upper," and the like, may be used herein for ease of description to describe one element or feature's relationship to another when the apparatus is right side up as shown in the accompanying drawings.

The terms "first," "second," "third," and the like are used herein to describe various features or elements, but these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the present disclosure.

The present disclosure provides an improved minigun rotor comprised of distinct components that can be removed from the rotor and subsequently replaced. The minigun rotor of the present disclosure advantageously provides for decreased machining and manufacturing costs by allowing for multiple sized pieces of raw material to be used to construct the rotor. In addition, because the components of the rotor are replaceable, the rotor can be serviced for repairs without having to disassemble the entire firearm like original designs had intended. This allows for more efficient serviceability and expedited repair times. Moreover, due to the replaceability and versatility of the rotor components, the rotor described herein can be used with parts from any manufacturer and does not require proprietary components specific to a certain manufacturer.

Referring to FIG. 1, a rotor 100 according to an exemplary embodiment of the present disclosure is shown. The rotor 100 shown in FIG. 1 is intended for operation in a M134 minigun; however, as will be readily apparent to one of ordinary skill in the art, the rotor 100 described herein may be adapted to perform in other types of firearms. As illustrated in FIG. 1, the rotor 100 of the present disclosure includes a tail 10 in which a camming section 15 and a barrel cluster head 20 are inserted thereon. The components of the rotor 100, including the tail 10, the camming section 15, and the barrel cluster head 20, provide the structure which keeps each barrel and bolt pair in-line as the rotor rotates and allows for the longitudinal displacement of each bolt as it travels with the rotor 100. As will be described in greater detail below, each of the camming section 15 and the barrel cluster head 20 are removably attached to the tail 10 such that the rotor 100 is formed of three distinct components. This allows for each of the components to be easily replaced (rather than the entire rotor) if a catastrophic failure occurs or the components need to be repaired or replaced due to wear and tear.

As shown in FIG. 1, the tail 10 has a plurality of depressions 40. Each depression 40 allows the bolt to slide forward and aft which allows ammunition to advance from a delinker/feeding system (not shown) as it enters the rotor housing. In the illustrated embodiment, the tail 10 has six depressions 40. Each depression 40 is defined by the two adjacent tail bosses 135 and corresponds to a barrel and cam from the camming section 15. The camming section 15 is positioned adjacent to and longitudinally aligned with each depression 40 to allow for the bolts to proceed through the firing sequence. The barrel cluster head 20 is positioned below and adjacent to the camming section 15 (as shown in FIG. 1).

Figure 2A:
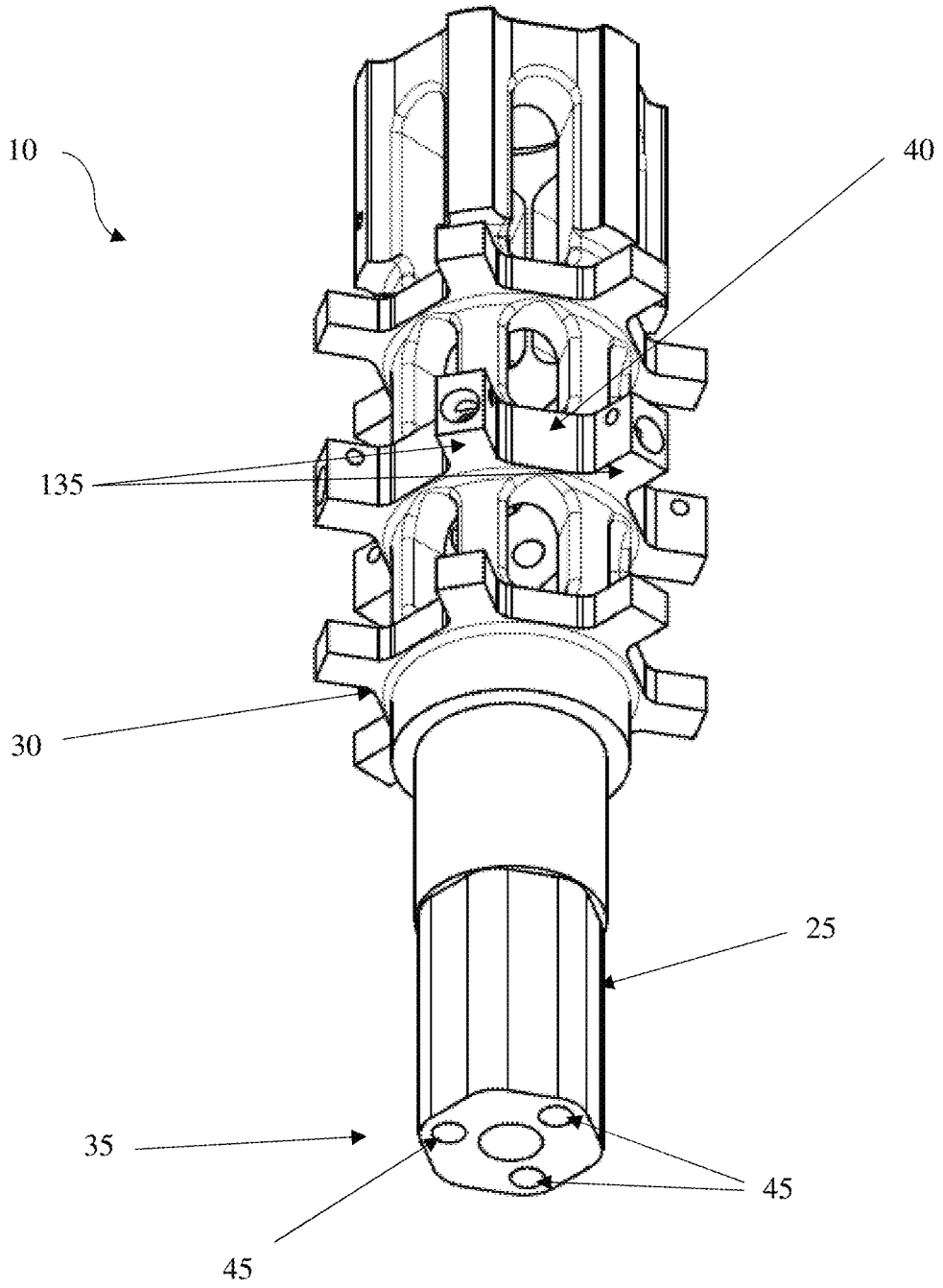
FIG. 2A is a front perspective view of a tail of the rotor shown in FIG. 1 according to an exemplary embodiment of the present disclosure.
Figure 2B:
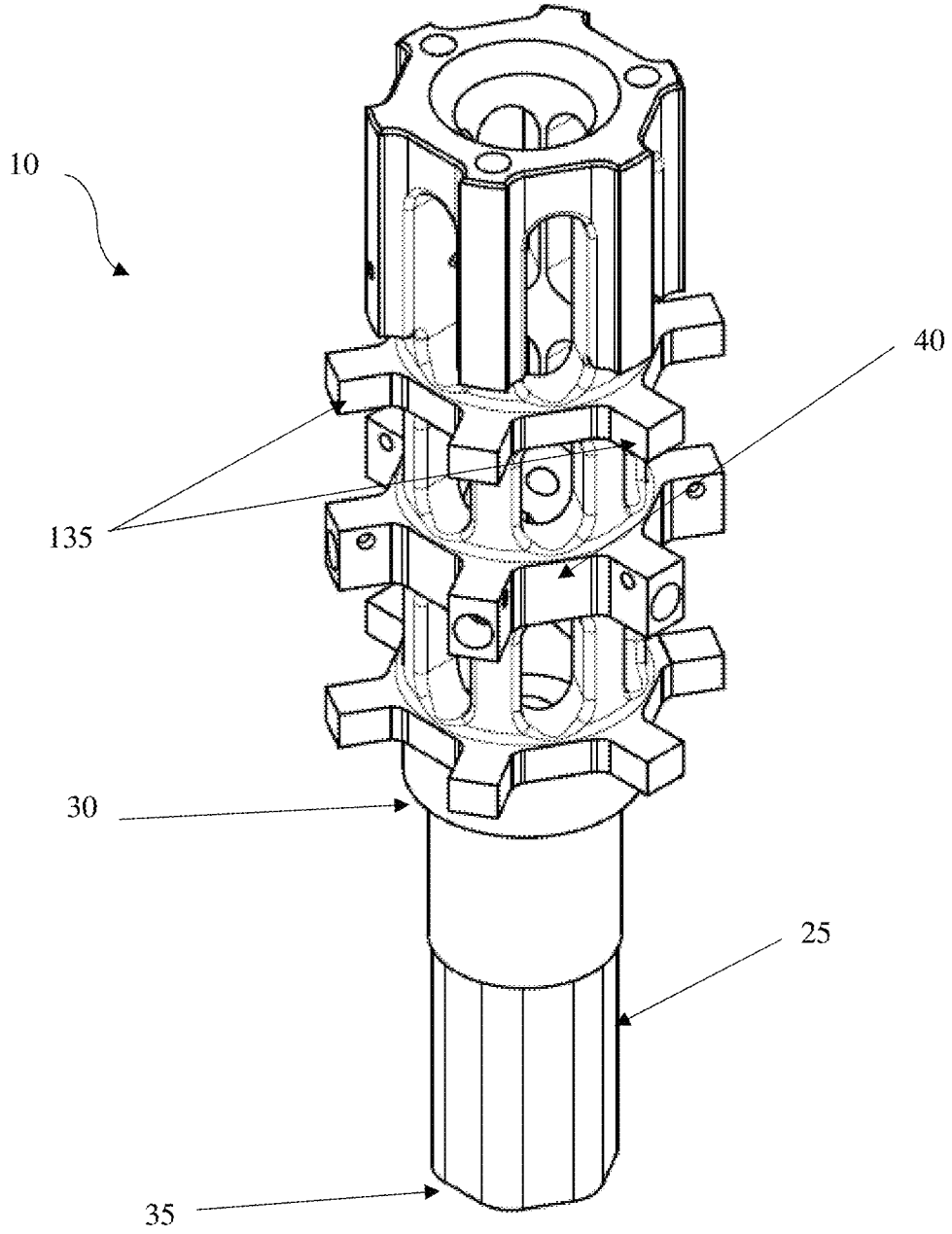
FIG. 2B is a rear perspective view of the tail shown in FIG. 2A.

FIGS. 2A and 2B are front and rear perspective views, respectively, of the tail 10. The tail 10 is the registered portion of the minigun. In one embodiment, the tail 10 of the rotor 100 includes a shaft 25 having a proximal end 35 and an opposite distal end 30. As illustrated in FIGS. 2A and 2B, a plurality of depressions 40 spaced between tail bosses 135 are operatively connected to the distal end 30 of the shaft 25. The plurality of depressions 40 run lengthwise parallel to the shaft 25, and the plurality of depressions 40 and tail bosses 135 are arranged radially such that they encircle the distal end 30 of the shaft 25. Each depression 40 is separated by one or more aligned tail bosses 135. The proximal end 35 of the shaft 25 is configured for receiving the camming section 15 and the barrel cluster head 20. For example, the camming section 15 and the barrel cluster head 20 may be inserted onto the shaft 25 in a linear configuration such that the camming section 15 is positioned adjacent to the plurality of depression 40 and the barrel cluster head 20 is positioned adjacent to the camming section 15 (as shown in FIG. 1).

In one embodiment, the proximal end 35 of the shaft 25 includes one or more receiving holes or slots 45 for removably attaching the barrel cluster head 20 to the shaft 25. In the embodiment illustrated in FIG. 2A, the proximal end 35 of the shaft 25 has three slots 45 positioned equidistant from each other and configured in a triangular pattern. When the camming section 15 and the barrel cluster head 20 are inserted onto the shaft 25, the barrel cluster head 20 can be secured to the proximal end 35 by inserting a fastener into each of the slots 45. The fastener may be any type of releasable securing means, such as pins, bolts, rods, or screws. While the use of three slots 45 configured in a triangular pattern has been exemplified in FIG. 2A, it will be readily apparent to one of ordinary skill in the art that any number and configuration of slots 45 may be used so long as the slots 45 allow for the barrel cluster head 20 to be securely (and removably) attached to the proximal end 35.

In some embodiments, the shaft 25 has a cross-sectional profile of a regular polygon. For example, as shown in FIG. 2A, the proximal end 35 of the shaft 25 has a hexagonal cross-sectional profile along at least a portion of the shaft 25. The polygonal shape is advantageous in that it allows for the camming section 15 and the barrel cluster head 20 to be assembled on the shaft 25 in any orientation. For instance, using the hexagonal profile, the barrel cluster head 20 can be rotatably oriented every 60 degrees and assembled to the tail 10 while the camming section 15 can be assembled in any orientation, and in each instance will attach to the tail 10 such that the rotor 100 may function as intended. As will be discussed in more detail below, the hexagonal shape is also complementary in shape to the cross-sectional profile of the openings on each of the camming section 15 and the barrel cluster head 20 that allow for the parts to be removably attached to the shaft 25.

As depicted in FIGS. 2A and 2B, the shaft distal end 30 stops at the location where the plurality of depressions 40 and tail bosses 135 meet the shaft 25. That is, the tail bosses 135 and depressions 40 are arranged radially around the distal end 30, but the shaft does not continue passing through the central space in the middle of the tail bosses 135 and depressions 40. In other embodiments, the shaft 25 could continue through the central space, such that a portion of, or the entire length of, the tail bosses 135 and depressions 40 are directly attached to the shaft 25. Such an embodiment may reduce machining costs and increase stability, but it would also result in a heavier tail 10.

A bolt track 105 is pinned, bolted, or otherwise attached to a tail boss 135. Together, the bolt tracks 105 on two adjacent tail bosses 135 define a pathway passing parallel to the direction of the shaft and along which a bolt is suspended between and contacting the two bolt tracks 105 and above the depressions 40. Accordingly, the bolt tracks 105 attached to adjacent tail bosses 135 define a guide that maintains the bolt within the pathway. A bolt track 105 may be bolted or pinned into place as is known in the art.

Figure 5A:
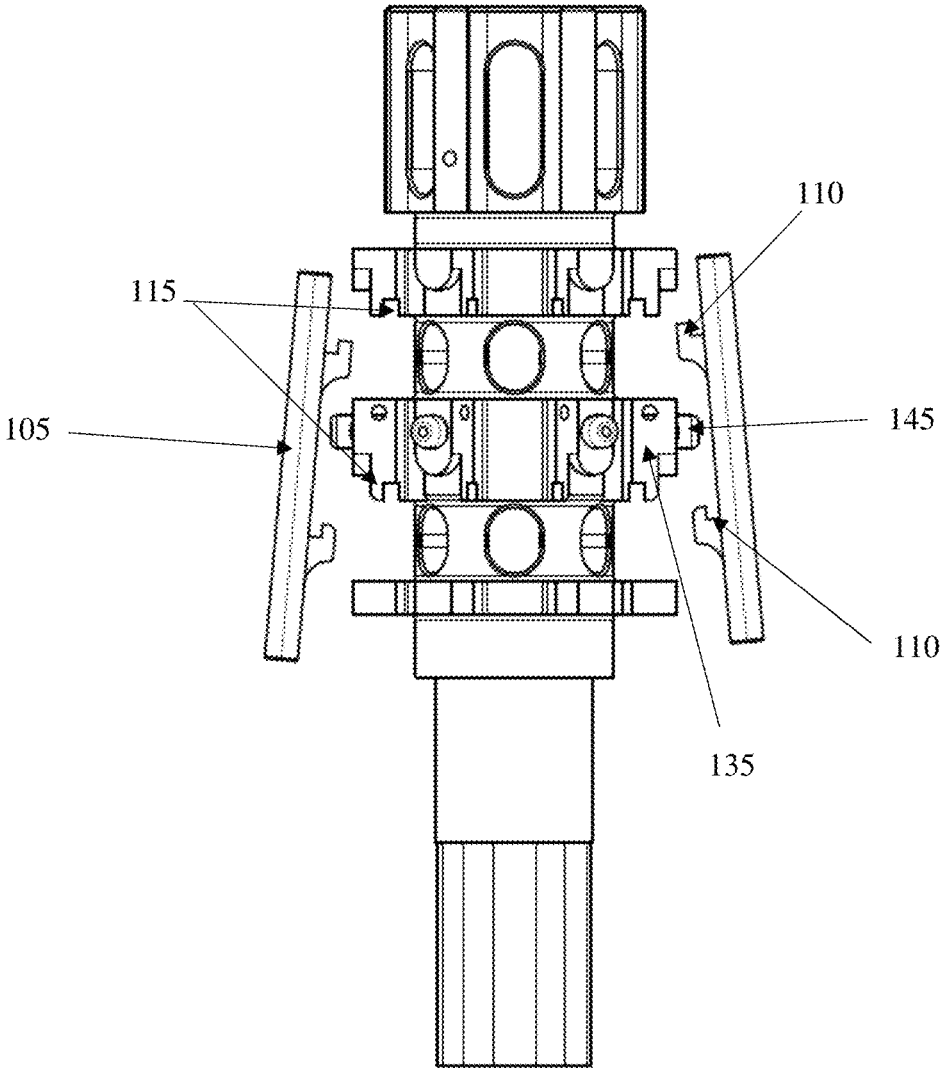
FIG. 5A is a side perspective view of the tail of the rotor having bolt tracks according to one embodiment of the present disclosure.
Figure 5B:
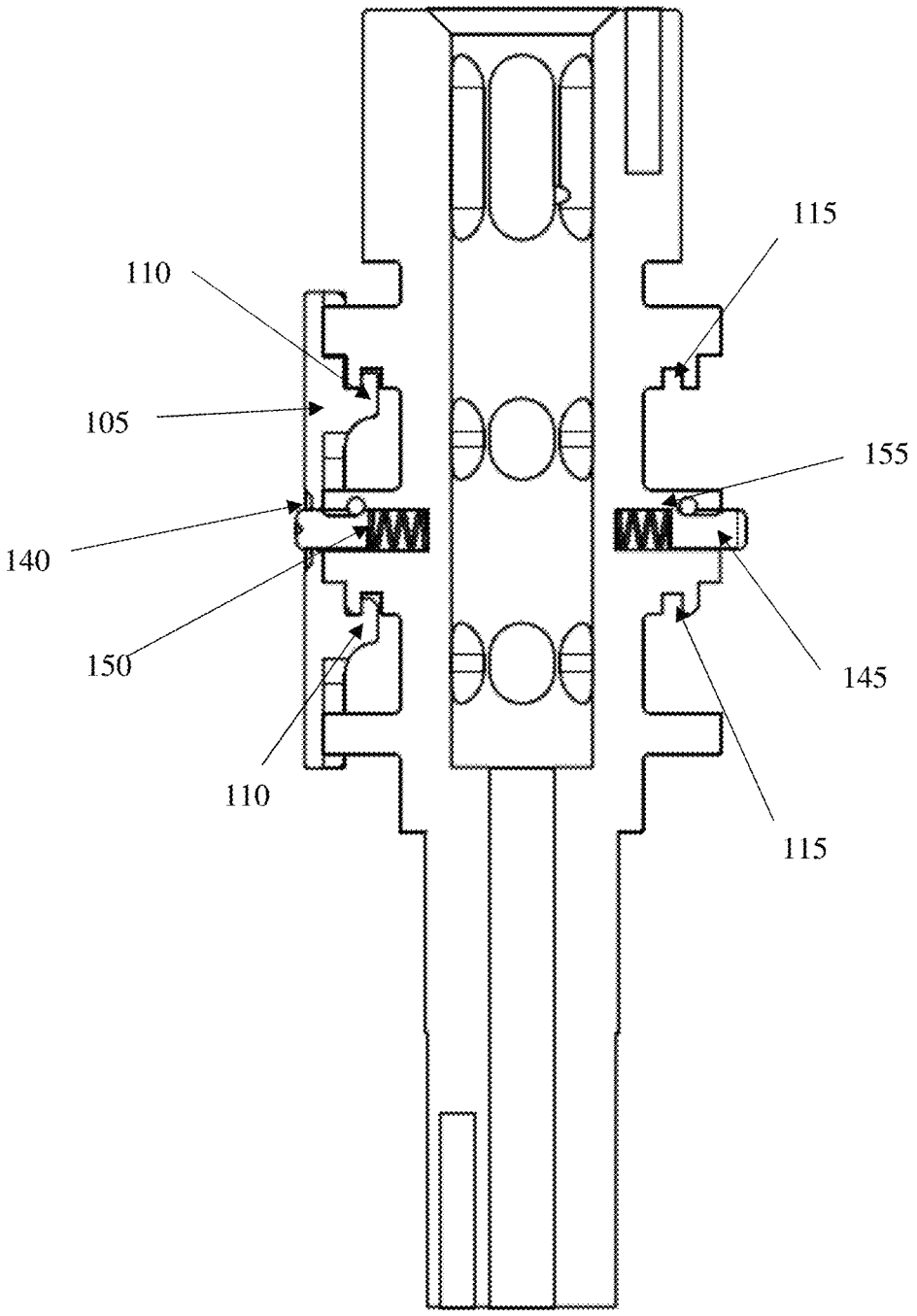
FIG. 5B is a side cut-through view of the tail of the rotor having bolt tracks according to one embodiment of the present disclosure.

In a different embodiment and as shown in FIGS. 5A and 5B, a bolt track 105 may have one or more locking clips 110, and each tail boss 135 to which the bolt tracks 105 is attached has corresponding receiving indentations 115. The bolt tracks 105 also has an aperture 140 through which a locking bolt 145 passes. The locking bolt 145 engages a spring 150 placed within a bolt hole 155 set within the tail boss 135, such that when the locking bolt is set, the spring 150 is compressed within the bolt hole 155. The bolt track 105 may be set in place by engaging the clips 110 of the bolt track 105 with the receiving indentations 115 on the tail boss 135 and snapping the bolt track 105 into place with the locking bolt 145 locking it in place. The bolt track 105 can then be unlocked by depressing the locking bolt 145, causing the spring 150 to release. This embodiment permits the bolt track 105 to be applied and removed without the need for tools, thereby permitting a user or mechanic to access the bolt held in place thereby in an efficient manner.

Figure 3A:
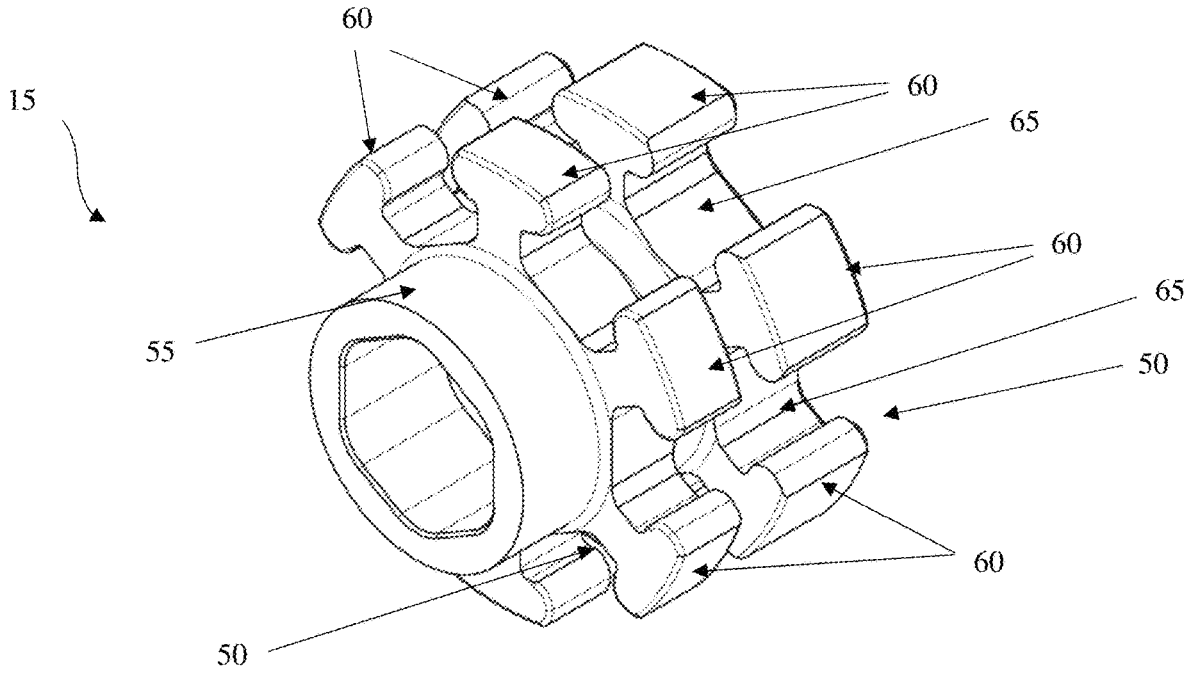
FIG. 3A is a front perspective view of a camming section of the rotor shown in FIG. 1 according to an exemplary embodiment of the present disclosure.
Figure 3B:
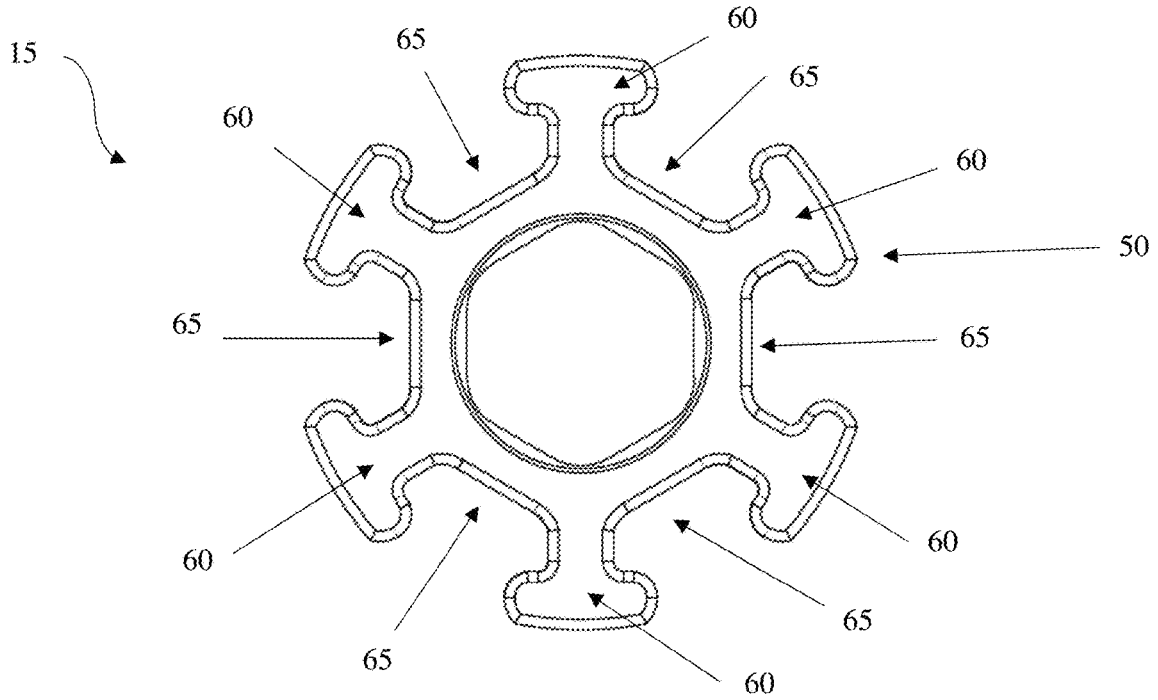
FIG. 3B is a rear view of the camming section shown in FIG. 3A.

FIGS. 3A and 3B are front and rear views, respectively, of the camming section 15. The camming section 15 of the rotor 100 has gaps 65 that align with each depression 40, wherein the bolt (not shown) slides forward to its forward-most firing position. The camming section 15 is removably attached to the shaft 25 of the tail 10 and is positioned in between the tail bosses 135 and the barrel cluster head 20. As illustrated in FIGS. 3A and 3B, the camming section 15 is mounted on a sleeve 55. Each cam 50 includes a plurality of cam bosses 60, which radially extend about the longitudinal axis of the sleeve 55. In the illustrated embodiment, each cam 50 has six cam bosses 60 spaced equidistant apart around the cam 50. Each adjacent pair of bosses 50 defines a gap 65 therebetween to serve as a pathway for the bolt. The cam bosses 60 on each of the cams 50 are intended to align with each other such that, during firing, the bolt head interfaces with the cam bosses 60 to secure the forward position of the bolt. As the bolt retracts, the bolt body is drawn back which untwists the head and releases it from the cams 50. FIGS. 3A and 3B depict two sections of camming bosses 60. Such an embodiment permits a rotor as described here to be used with different generations and/or manufacturer variations of guide bars (not shown). A guide bar guides ammunition into the rotor 100 from the delinker and ejects ammunition after the rotor 100 creates a full revolution and cycle of operation. By having two separate sections of camming bosses 60 as shown, one is not limited to a specific guide bar design. However, in other embodiments, the rotor 100 may have only one section of camming bosses 60.

As shown in FIGS. 3A and 3B, the sleeve 55 is cylindrically shaped and has a hexagonal cross-sectional profile. The cross-sectional profile of the sleeve 55 is intended to provide a complementary fit with the shaft 25 such that the camming section 15 can easily slide on and off of the shaft 25. Due to the hexagonal cross-sectional profile, the sleeve 55 can also be inserted onto the shaft 25 in any orientation.

Figure 3C:
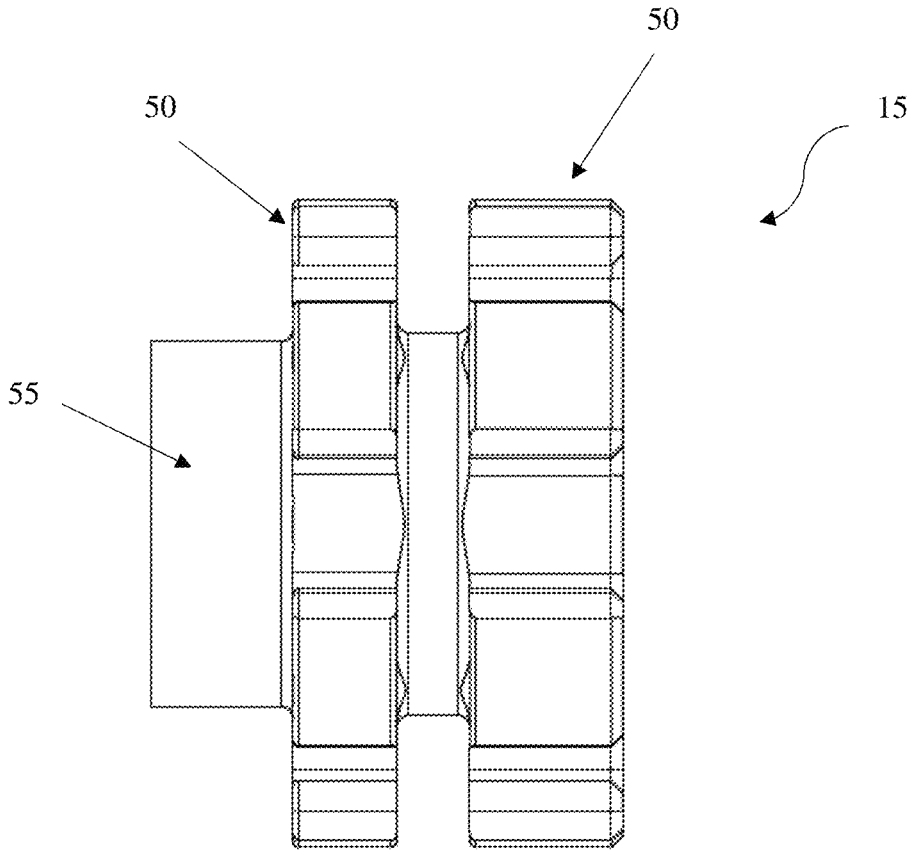
FIG. 3C is a side view of the camming section shown in FIG. 3A.

FIG. 3C is a side view of the camming section 15. As shown in FIG. 3C, the cams 50 are mounted on the sleeve 55 and are positioned adjacent to one another. In one embodiment, the cams 50 are spaced apart on the sleeve 55 such that the cams 50 do not contact each other. However, as noted above, the cam bosses 60 (and the gaps 65 therebetween) on each of the cams 50 are intended to align to form a track in which the bolt can interface with the cam bosses 60.

Figure 4A:
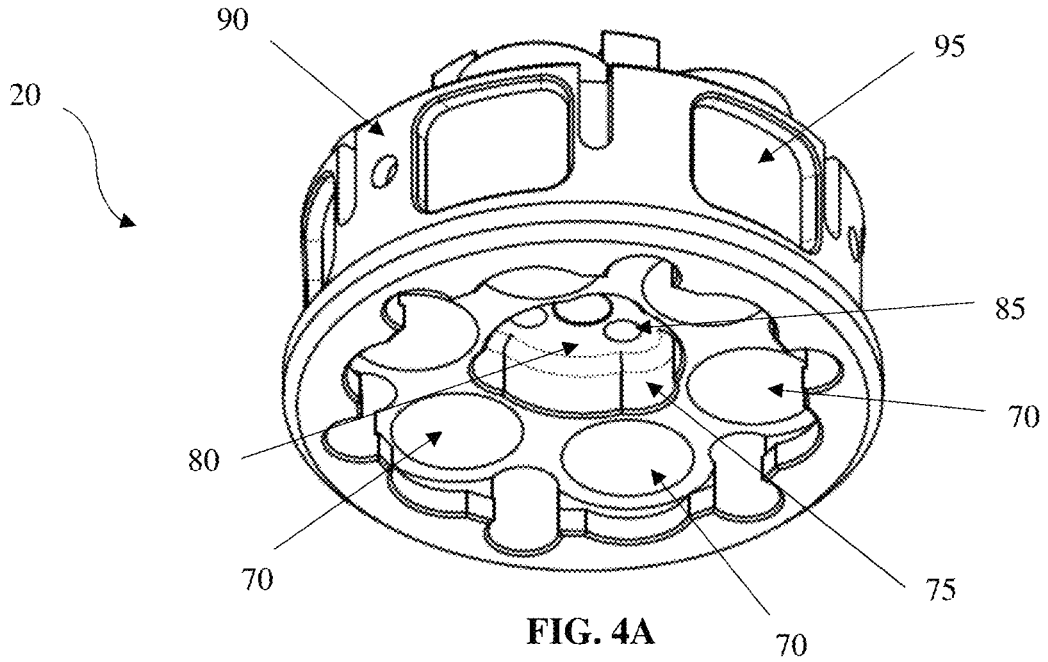
FIG. 4A is a front perspective view of a barrel cluster head of the rotor shown in FIG. 1 according to an exemplary embodiment of the present disclosure.
Figure 4B:
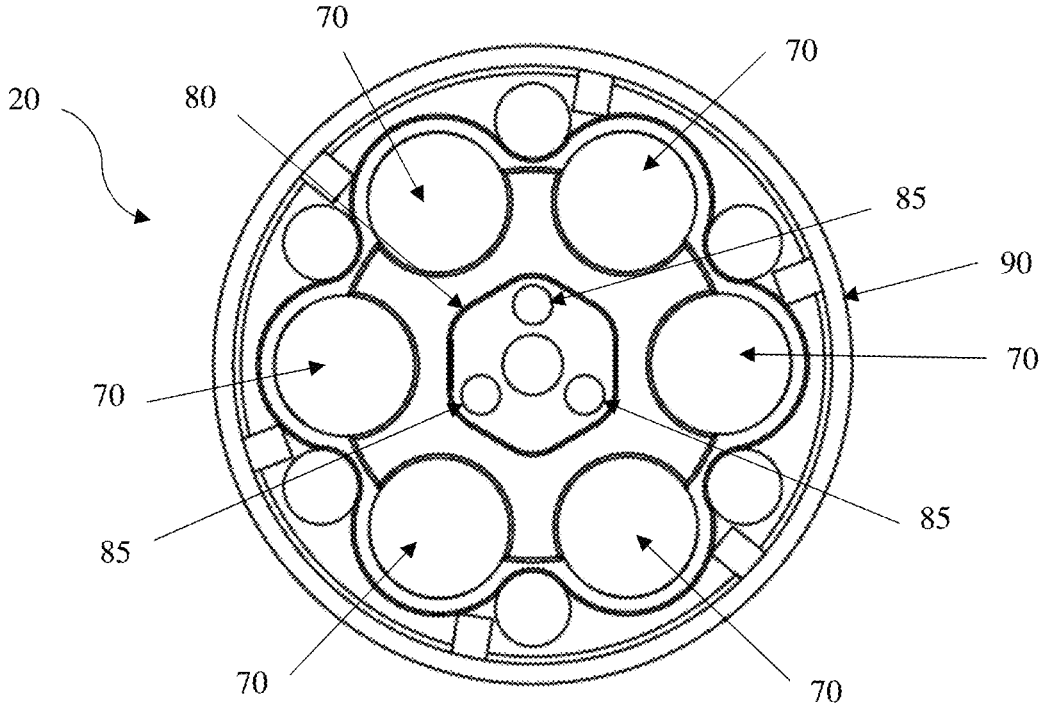
FIG. 4B is a back view of the barrel cluster head shown in FIG. 4A.
Figure 4C:
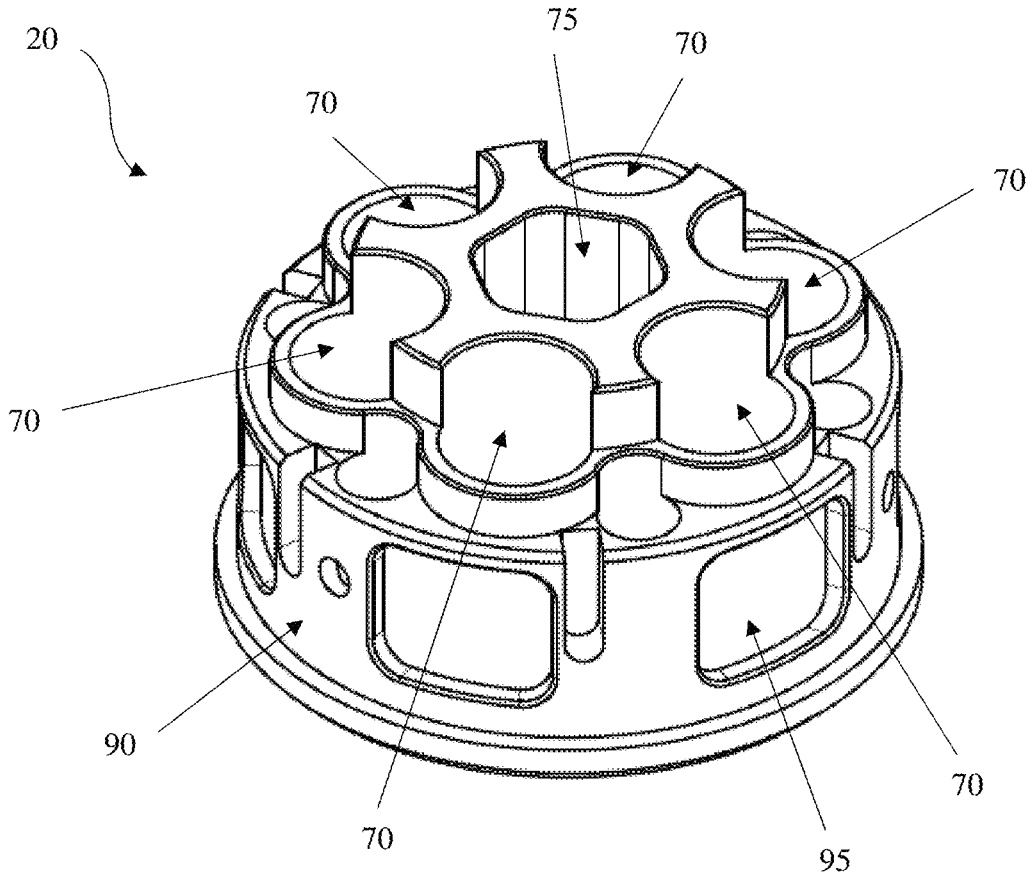
FIG. 4C is a rear view of the barrel cluster head shown in FIG. 4A.

FIGS. 4A and 4B are front views of the barrel cluster head 20. FIG. 4C is a rear view of the barrel cluster head 20. As shown in FIGS. 4A-4C, the barrel cluster head 20 includes a plurality of barrel apertures 70 for receiving the barrels (not shown) and holding them parallel to the longitudinal axis of the barrel cluster head 20. In the illustrated embodiment, the barrel cluster head 20 has six barrel apertures 70 symmetrically disposed equidistant apart and equidistant from the central longitudinal axis of the barrel cluster head 20 for holding the barrels (not shown) in a circumferential, spaced relationship. A circumferential wall 90 having one or more holes 95 disposed therein may surround the plurality of barrel apertures 70 to relieve overpressure and trapped gasses in case of a catastrophic failure.

As illustrated, the center of the barrel cluster head 20 includes an opening 75 for receiving the proximal end 35 of the shaft 25. The barrel apertures 70 are circumferentially spaced around the opening 75. In one embodiment, the opening 75 is hexagonally shaped to provide for a complementary fit when the barrel cluster head 20 is inserted onto the proximal end 35 of the shaft 25. The opening 75 may also include a plate 80 disposed therein having one or more slots 85 for fastening the barrel cluster head 20 to the proximal end 35 of the shaft 25. In the illustrated embodiment, the plate 80 includes three slots 85 arranged in a triangular pattern matching that of the triangular pattern of the receivable holes or slots 45 on the proximal end 35 (as shown in FIG. 2A). The identical arrangements of the slots 45 on the proximal end 35 and the slots 85 on the plate 80 allow for the barrel cluster head 20 to be fastened to the rotor tail's front shaft 25 with a releasable securing means, such as pins, bolts, rods, or screws.

Figures 6A, 6B:
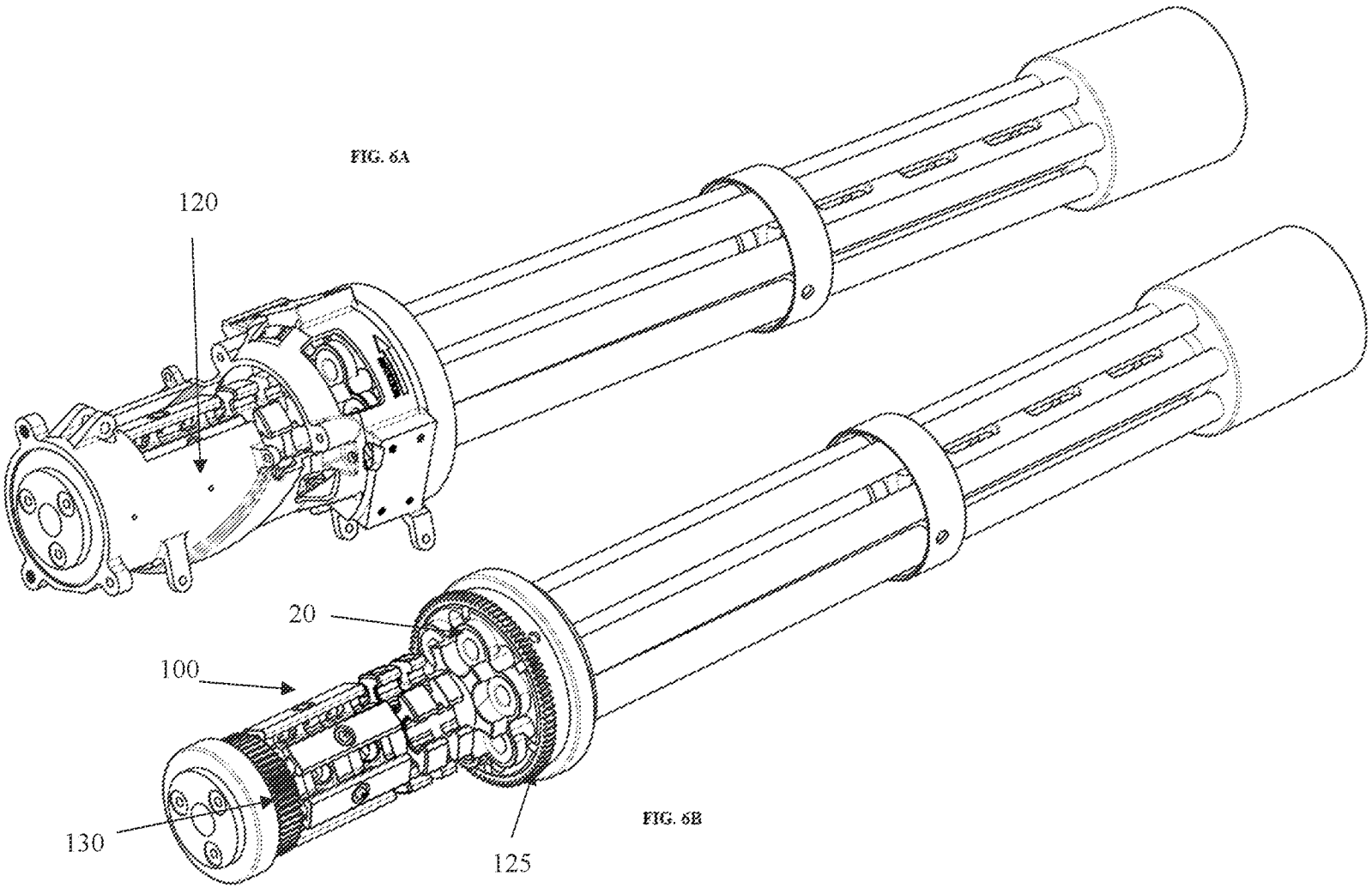
FIG. 6A is a perspective view of a fully assembled rotor shown within geared bearings and a housing according to one embodiment of the present disclosure.
FIG. 6B is a perspective view of a fully assembled rotor shown within geared bearings according to another embodiment of the present disclosure.

After assembled as described herein, the rotor 100 is inserted into a housing 120 such that the barrel cluster head 20 is seated within a first geared bearing 125 that is drivable by a motor (not shown). When the motor drives the first gear 125, the entire rotor assembly 100 rotates about a longitudinal axis passing through the shaft 25. On the opposite end of the rotor 100 from the first geared bearing 125, a second geared bearing 130 may be attached to and rotate with the rotor 100. This second gear 130 may be used to drive the delinker assembly (not shown). In this manner a single motor is used to drive both the rotor and the delinker. A fully assembled rotor 100 within the geared bearings and housing is shown in FIGS. 6A and 6B.

The various components of the rotor 100 described herein, such as the tail 10, the camming section 15, and the barrel cluster head 20, may be constructed or manufactured from materials, such as various polymers, plastics, stainless steel, aluminum, and combinations thereof. Preferably the material is one of high strength. For example, in some embodiments the material may have a yield stress of at least about 880 MPa and low elasticity such as a Young's modulus of about 104 GPa. In one embodiment, various components of the rotor 100 described herein, such as the tail 10 and the barrel cluster head 20, may be constructed from titanium alloy, such as Ti-6A1-4V alloy. The camming section 15 may be constructed out of heat treated or heat coated 4340 steel. Similarly, the various parts described herein may be constructed according to various manufacturing methods including injection molding, milling, forging, extrusion, pressing, 3D printing, and other related manufacturing methods. In some embodiments, the various components of the rotor 100 may be coated and heat treated to withstand the extensive operation of the firing cycles.

The rotors described and claimed herein are not to be limited in scope by the specific embodiments herein disclosed, since these embodiments are intended as illustrations of several aspects of the disclosure. Any equivalent embodiments are intended to be within the scope of this disclosure. Indeed, various modifications of the rotors in addition to those shown and described herein will become apparent to those skilled in the art from the foregoing description. Such modifications are also intended to fall within the scope of the appended claims. All patents and patent applications cited in the foregoing text are expressly incorporated herein by reference in their entirety. Any section headings herein are provided only for consistency with the suggestions of 37 C.F.R. § 1.77 or otherwise to provide organizational queues. These headings shall not limit or characterize the invention(s) set forth herein.

What is claimed is:

1. A rotor for a minigun, comprising:

a tail comprising a shaft having a distal end and a proximal end, wherein a plurality of tail bosses are arranged radially around the distal end of the shaft;

a plurality of bolt tracks, each bolt track attached to a tail boss, wherein two adjacent bolt tracks define a pathway;

a camming section mounted on a sleeve, wherein the sleeve is configured to removably engage the shaft adjacent to the bolt tracks, the camming section further having a plurality of bosses arranged radially around the sleeve and corresponding to each of the plurality of bolt tracks; and a barrel cluster head comprising a plurality of barrel apertures, wherein the barrel cluster head is configured to removably engage the shaft and secure to the proximal end of the shaft.

2. The rotor of claim 1, wherein the barrel cluster head further comprises an opening and a plate disposed therein configured for attachment to the proximal end of the shaft.

3. The rotor of claim 2, wherein the proximal end, the camming section sleeve, and the opening on the barrel cluster head each comprise a hexagonal cross-sectional profile.

4. The rotor of claim 2, wherein the proximal end of the shaft and the plate of the barrel cluster head each comprise complementary slots for insertion of a releasable fastener.

5. The rotor of claim 1, further comprising a plurality of tail bosses dividing the pathway wherein each bolt track is securable to and overlaps a plurality of the tail bosses.

6. The rotor of claim 5, wherein one of the plurality of tail bosses comprises a receiver, and a bolt track that comprises a clip is insertable into the receiver for securing the bolt track to one of the plurality of tail bosses.

7. A rotor for a minigun comprising:

a tail having a plurality of bosses, at least one boss having an indentation for receiving a clip and a locking bolt hole;

a bolt track securable to the at least one boss and having an aperture passing through the bolt track and a clip insertable into the indentation; and a spring-loaded locking bolt configured to pass through the aperture in the bolt track and be removably secured within the locking bolt hole.

* * * * *